US010457077B2

(12) United States Patent
Sakurai

(10) Patent No.: US 10,457,077 B2
(45) Date of Patent: Oct. 29, 2019

(54) PRINTER

(71) Applicants: CITIZEN WATCH CO., LTD., Tokyo (JP); CITIZEN SYSTEMS JAPAN CO., LTD., Tokyo (JP)

(72) Inventor: Hiroshi Sakurai, Saitama (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 2 days.

(21) Appl. No.: 15/796,741

(22) Filed: Oct. 27, 2017

(65) Prior Publication Data

US 2018/0117908 A1 May 3, 2018

(30) Foreign Application Priority Data

Oct. 28, 2016 (JP) ..... 2016-212287

(51) Int. Cl.
*B41J 11/46* (2006.01)
*B41J 29/38* (2006.01)

(52) U.S. Cl.
CPC ..... *B41J 11/46* (2013.01)

(58) Field of Classification Search
CPC ..... B41J 11/009; B41J 11/0095; B41J 11/42; B41J 11/46; B41J 15/046; B41J 15/044; B41J 29/38; B41J 29/393
See application file for complete search history.

(56) References Cited

U.S. PATENT DOCUMENTS

2009/0224020 A1* 9/2009 Oi ..... B65H 26/00 226/1
2010/0208026 A1 8/2010 Yoshie
2010/0238255 A1* 9/2010 Inaba ..... B41J 11/009 347/218
2012/0069068 A1* 3/2012 Ito ..... B41J 2/17506 347/6
2016/0272451 A1* 9/2016 Yamashita ..... B65H 23/038
2017/0015120 A1* 1/2017 Campanini ..... B41J 3/4075

FOREIGN PATENT DOCUMENTS

JP H05-060947 B2 9/1993
JP H06-011993 Y2 3/1994
JP 2005-001887 A 1/2005
JP 2010-189157 A 9/2010
JP 2010-214813 A 9/2010
JP 2014-084221 A 5/2014
JP 2015-209296 A 11/2015

* cited by examiner

*Primary Examiner* — Scott A Richmond

(57) ABSTRACT

Provided is a printer including a conveying unit conveying a continuous sheet in accordance with an input print instruction, a plurality of sensors detecting a mark serving as a reference for positioning a print area on the continuous sheet, wherein the plurality of sensors adopt marks different from each other as detection targets, a printing unit printing on a print area of the continuous sheet, a storage unit storing priority information about a sensor to be used preferentially among the plurality of sensors, and a control unit controlling the conveying unit so that the print area is positioned at a print position of the printing unit on the basis of the priority information and a detection result indicating whether each of the plurality of sensors has detected the mark or not during conveying of the continuous sheet while the priority information is stored in advance.

12 Claims, 10 Drawing Sheets

PRINTER

CROSS REFERENCE TO RELATED APPLICATION

This application is a new U.S. patent application that claims benefit of JP2016-212287, filed on Oct. 28, 2016. The entire contents of JP2016-212287 are hereby incorporated by reference.

TECHNICAL FIELD

The present invention relates to a printer.

BACKGROUND

A printer that prints on an elongated continuous sheet has a sensor for detecting a mark such as a black mark or a notch in the sheet which serves as a reference for positioning the print area. Some printers have multiple such sensors so as to be able to support various kinds of sheets such as a ticket sheet and a label sheet.

SUMMARY

If the function is provided to monitor the output of each sensor to select a sensor that detected the mark at the earliest point in time while the sheet is conveyed, it is not necessary for the user to select the sensor that matches the sheet every time the type of sheet to be used is changed. However, some of the continuous sheets are provided with, for example, multiple types of marks such as black marks and notches, which are used as positioning reference. When such a sheet is used, for example, there are times when it is desirable to perform printing on the basis of the position of the black mark or on the basis of the position of the notch. Therefore, when a sensor is selected based on the order of detection by each sensor, the user's demand cannot be necessarily satisfied.

It is an object of the present invention to provide a printer that can realize printing based on a positioning mark matching user's demand out of the positioning marks formed on the continuous sheet to be used, with an operation easy for the user.

Provided is a printer including a conveying unit conveying a continuous sheet in accordance with an input print instruction, a plurality of sensors detecting a mark serving as a reference for positioning a print area on the continuous sheet, wherein the plurality of sensors adopt marks different from each other as detection targets, a printing unit printing on a print area of the continuous sheet, a storage unit storing priority information about a sensor to be used preferentially among the plurality of sensors, and a control unit controlling the conveying unit so that the print area is positioned at a print position of the printing unit, on the basis of the priority information and a detection result indicating whether each of the plurality of sensors has detected the mark or not during conveying of the continuous sheet, while the priority information is stored in advance.

Further, provided is a printer including a conveying unit conveying a continuous sheet in accordance with an input print instruction, a plurality of sensors detecting a mark serving as a reference for positioning a print area on the continuous sheet, wherein the plurality of sensors adopt marks different from each other as detection targets, a printing unit printing on a print area of the continuous sheet, a receiving unit receiving information on priority ranks of the plurality of sensors before conveying of the continuous sheet is started in response to the print instruction, and a control unit performing specifying processing for specifying, from among the plurality of sensors, a sensor which has detected the mark before a head of the print area is conveyed to a print position of the printing unit and whose priority rank is the highest, wherein the control unit controls the conveying unit so that the print area is positioned at the print position on the basis of a detection result with the specified sensor.

The above printer can realize printing based on a positioning mark matching user's demand out of the positioning marks formed on the continuous sheet to be used, with an operation easy for the user.

BRIEF DESCRIPTION OF THE DRAWINGS

Other features and advantages of the present invention will be apparent from the ensuing description, taken in conjunction with the accompanying drawings, in which.

DESCRIPTION

Figure 1:
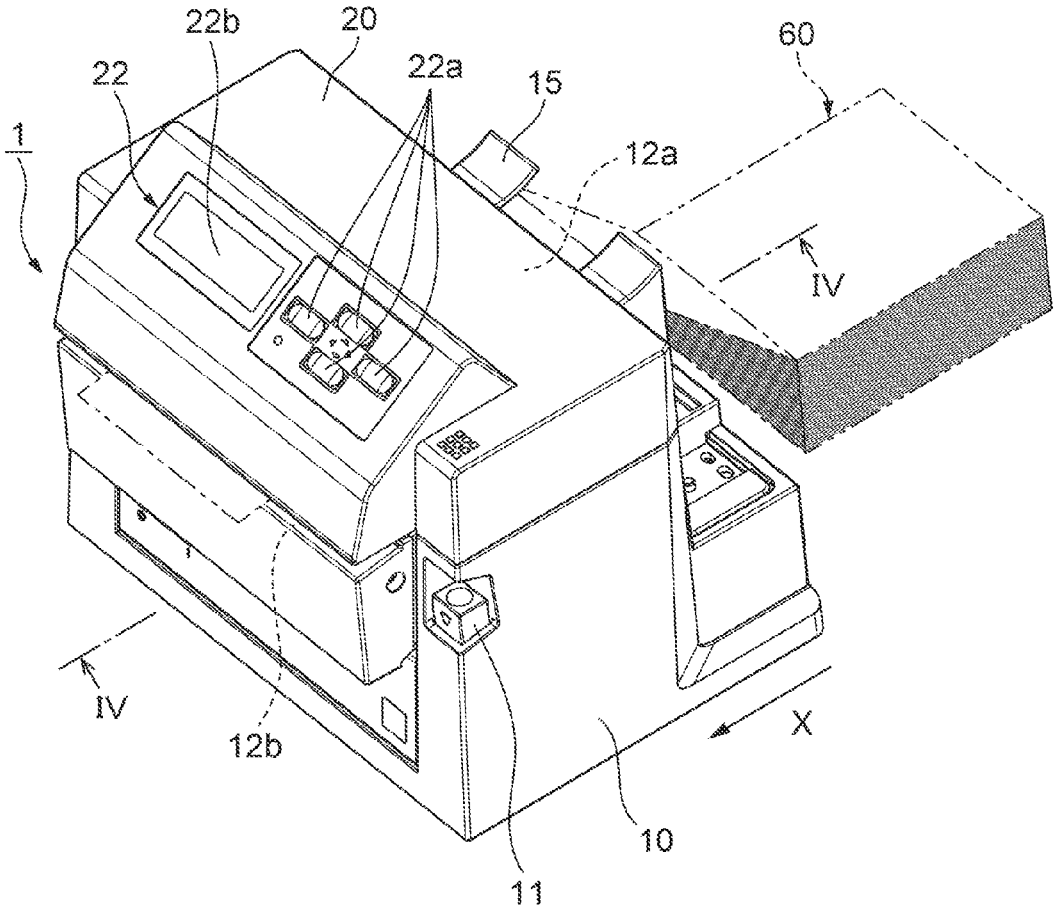
FIG. 1 is a perspective view illustrating the appearance of a printer 1.
Figure 2:
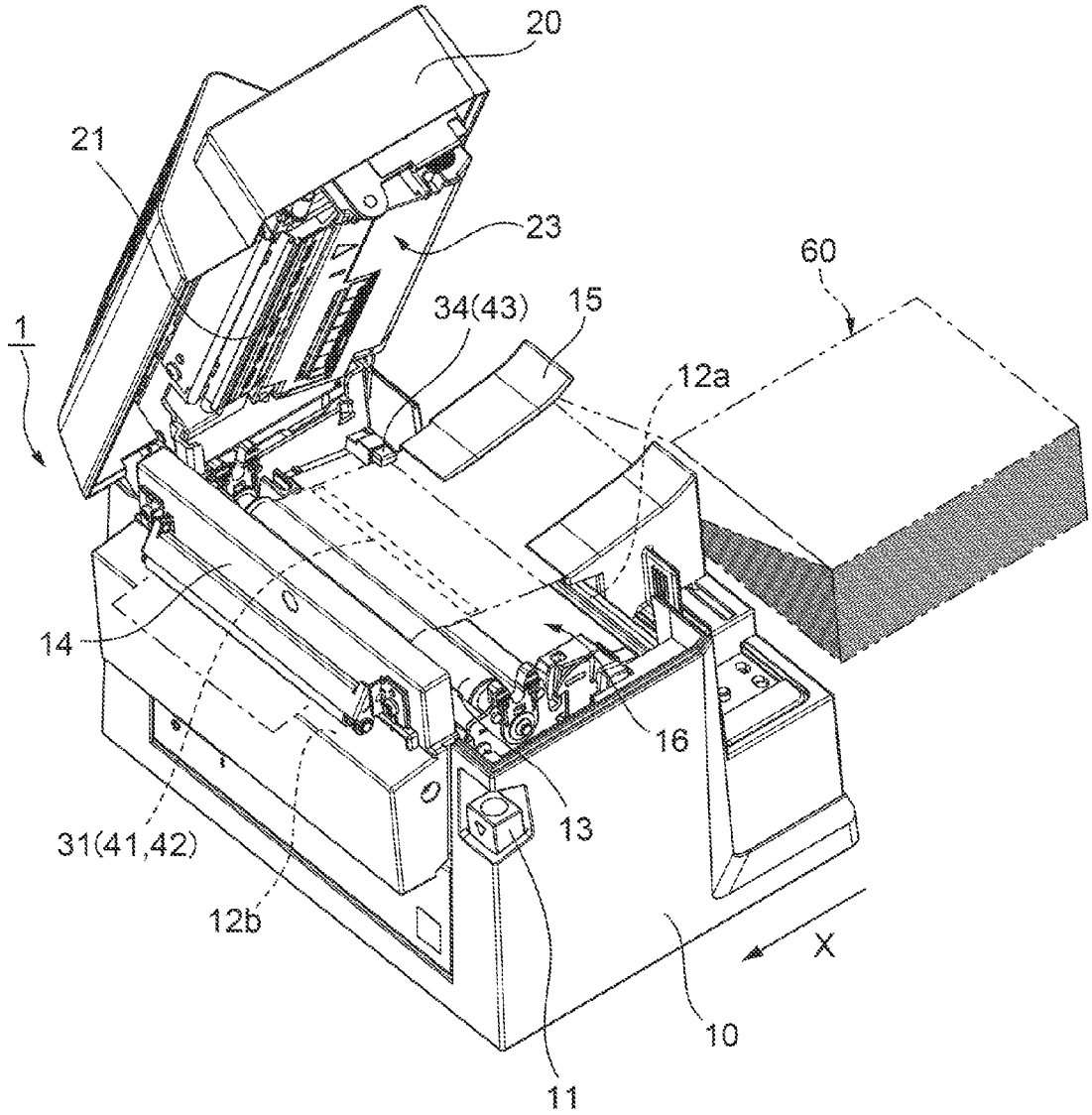
FIGS. 2 and 3 are perspective views of the printer 1 with a cover 20 opened.
Figure 3:
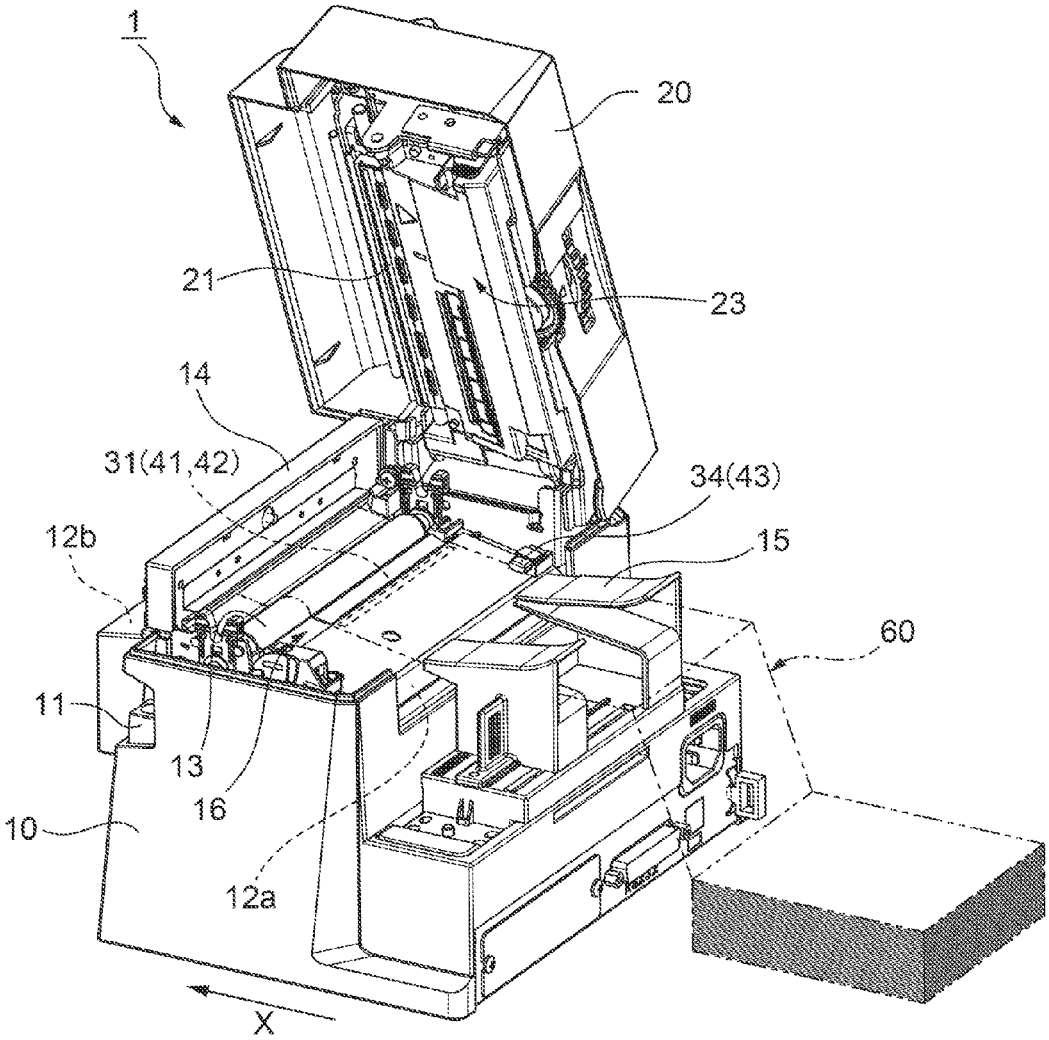
Figure 4:
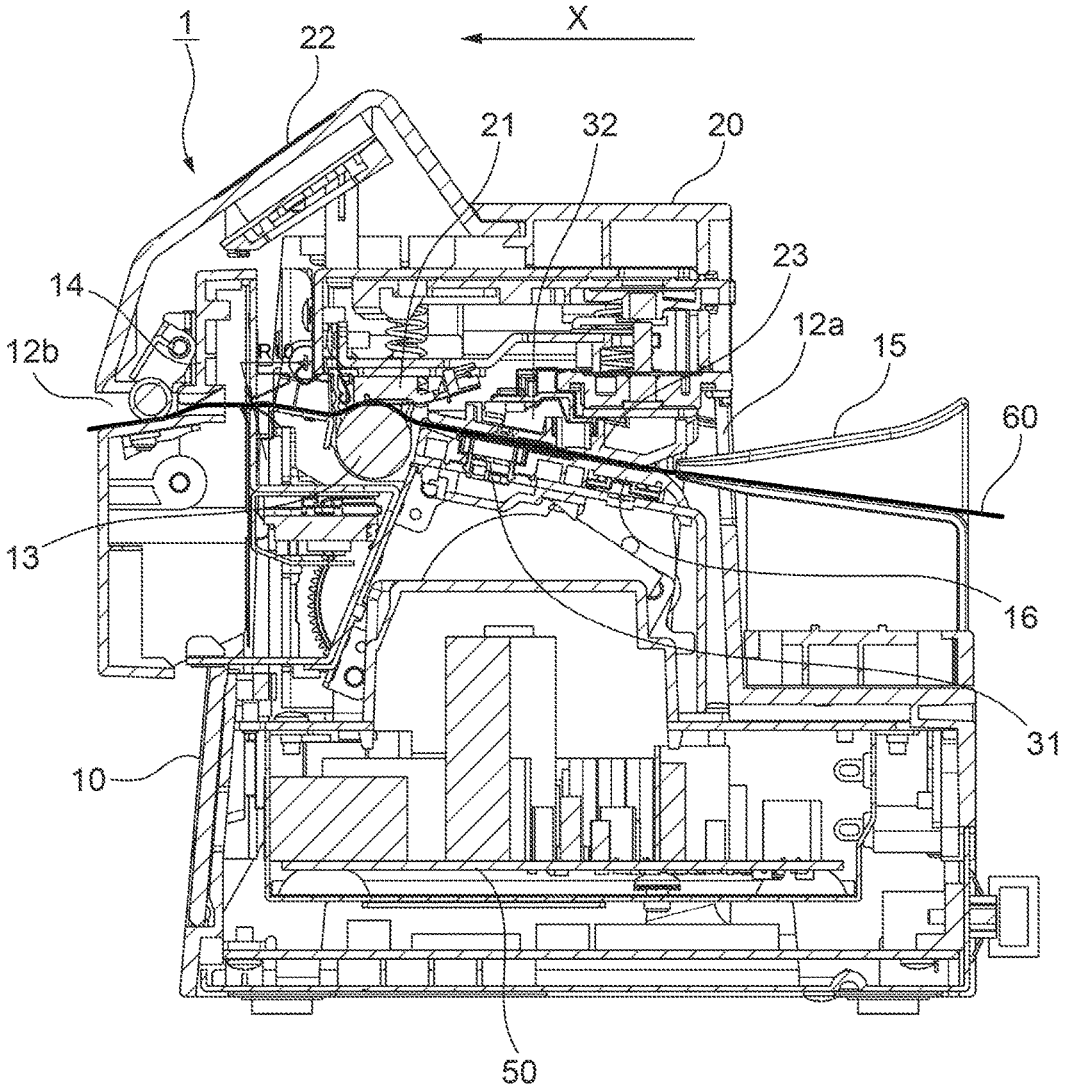
FIG. 4 is a cross-sectional view of the printer 1 taken along line IV-IV of FIG. 1.

FIG. 1 is a perspective view illustrating the appearance of a printer 1. FIGS. 2 and 3 are perspective views of the printer 1 with a cover 20 opened. FIG. 4 is a cross-sectional view of the printer 1 taken along line IV-IV of FIG. 1. The printer 1 is a thermal printer that performs printing (printing characters) by applying heat from a thermal head to a sheet 60, which is thermal paper, to develop color.

The printer 1 has a main body 10 and a cover 20. The cover 20 covers the upper part of the main body 10, and when an opening and closing button 11 provided in the main body 10 is pushed down, the cover 20 rotates and opens laterally as illustrated in FIGS. 2 and 3. The printer 1 is used with the cover 20 closed.

As illustrated in FIG. 4, a sheet supply port 12*a* is formed between the main body 10 and the cover 20 on the rear side of the printer 1, and a sheet discharge port 12*b* is formed between the main body 10 and the cover 20 on the front side of the printer 1. The sheet 60 is supplied from the sheet supply port 12*a* into the printer 1, printed in the printer 1, and discharged from the sheet discharge port 12*b*. The X direction from the sheet supply port 12*a* to the sheet discharge port 12*b* is the conveying direction of the sheet 60.

In the illustrated example, the sheet 60 is an elongated continuous sheet folded in a bellows shape, but the sheet used in the printer 1 may be a continuous sheet wound in a roll.

As illustrated in FIGS. 1 to 4, the printer 1 includes a platen roller 13, a cutter unit 14, a sheet insertion guide 15, a lower side sheet guide 16, a thermal head 21, an operation unit 22, an upper side sheet guide 23, a lower side sensor 31, an upper side sensor 32, and a control board 50.

The platen roller 13 is rotatably held by the main body 10 and faces the thermal head 21, and presses the sheet 60 from the lower side toward the thermal head 21. Thus, at the time of printing, the sheet 60 is held between the platen roller 13 and the thermal head 21, and in this state, the platen roller 13 rotates so that the sheet 60 is conveyed. The platen roller 13 is an example of a conveying unit that conveys a continuous sheet in accordance with an input print instruction.

The cutter unit 14 is disposed between the sheet discharge port 12*b* and the platen roller 13 in the main body 10. The cutter unit 14 cuts the rear end of the print area of the sheet 60 conveyed by the platen roller 13 and discharged from the sheet discharge port 12*b*. The sheet insertion guide 15 is a member an end portion of which is inserted into the sheet supply port 12*a*. The sheet insertion guide 15 has a frame shape in which an end portion at the sheet supply port 12*a* is tapered. The sheet insertion guide 15 regulates the position of the sheet 60 in the width direction. The lower side sheet guide 16 is arranged on the upper part of the main body 10 so as to face the lower surface of the sheet 60 to be conveyed on the side closer to the sheet supply port 12*a* (the upstream side in the conveying direction) with respect to the platen roller 13. The lower side sheet guide 16 regulates the position of the sheet 60 in the thickness direction.

The thermal head 21 is disposed at a position facing the platen roller 13 inside of the cover 20. The thermal head 21 has small heating elements aligned in a straight line, and heats the heating elements according to print data to apply the heat to the sheet 60, thereby printing characters or images on the sheet 60. The position where the platen roller 13 and the thermal head 21 are arranged on the conveying path of the sheet 60 from the sheet supply port 12*a* to the sheet discharge port 12*b* corresponds to the print position. The platen roller 13 and the thermal head 21 are an example of a printing unit that prints on a print area of a continuous sheet. The platen roller 13 also serves as a conveying unit and a printing unit of the printer 1.

The operation unit 22 is provided on the front side of the cover 20 as illustrated in FIG. 1. The operation unit 22 has a plurality of operation buttons 22*a* and a liquid crystal display screen 22*b*. The operation buttons 22*a* are used by the user to input print instructions and various settings of the printer 1. The liquid crystal display screen 22*b* displays the state of the printer 1 and the like.

The upper side sheet guide 23 is disposed at the lower side of the cover 20 so as to face the upper surface of the sheet 60 to be conveyed on the side closer to the sheet supply port 12*a* with respect to the thermal head 21. The upper side sheet guide 23 regulates the position of the sheet 60 in the thickness direction. The sheet 60 passes through the space formed between the lower side sheet guide 16 and the upper side sheet guide 23.

Figure 5A:
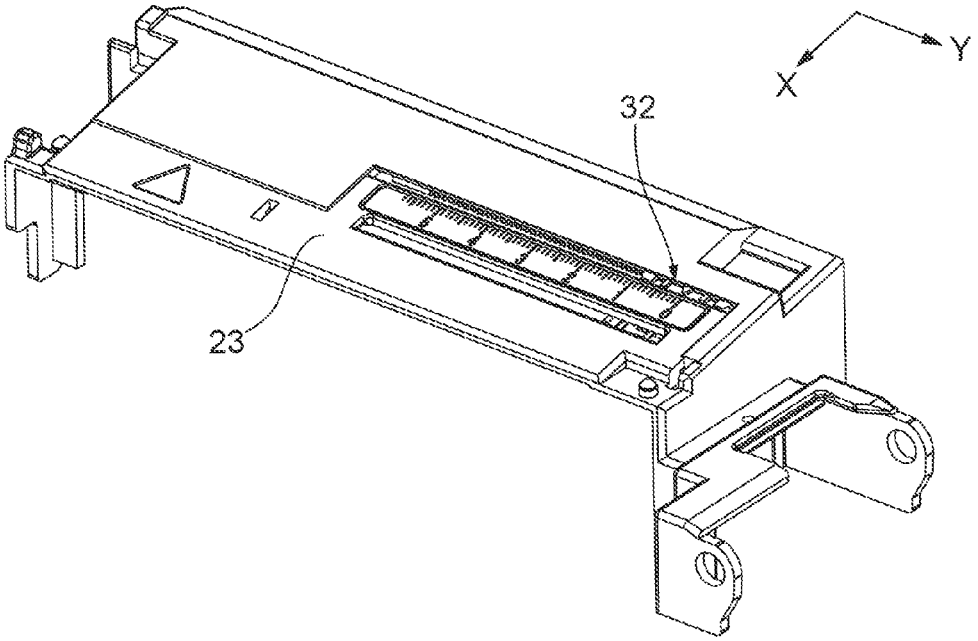
FIGS. 5A and 5B are perspective views illustrating the arrangement of the lower side sensor 31 and the upper side sensor 32.
Figure 5B:
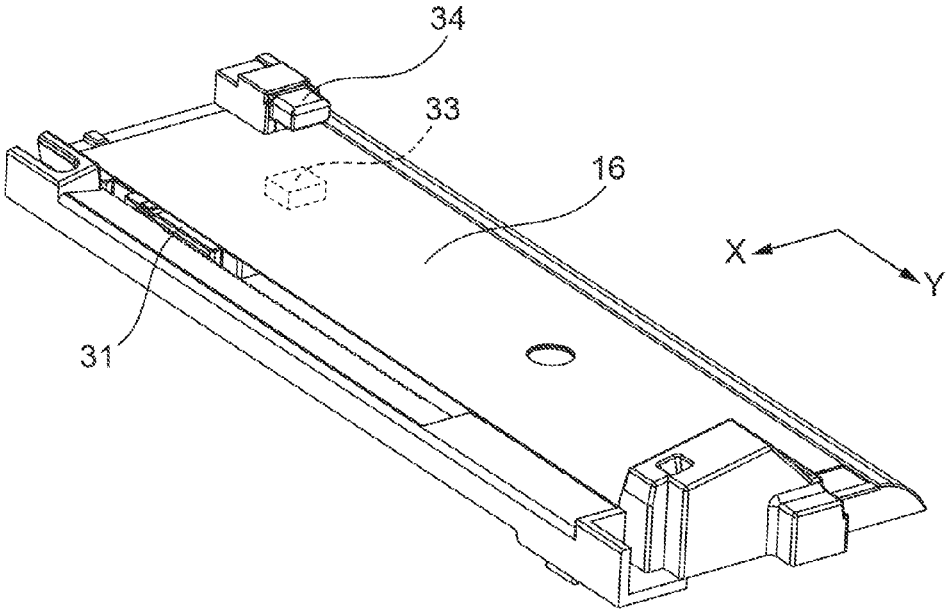

FIGS. 5A and 5B are perspective views illustrating the arrangement of the lower side sensor 31 and the upper side sensor 32. As illustrated in FIG. 5B, the lower side sensor 31 is arranged inside of the elongated hole formed in the lower side sheet guide 16. As illustrated in FIG. 5A, the upper side sensor 32 is arranged inside of the elongated hole formed in the upper side sheet guide 23. Therefore, the lower side sensor 31 and the upper side sensor 32 are disposed between the sheet supply port 12*a* and the platen roller 13 and the thermal head 21 in the conveying path of the sheet 60. The lower side sensor 31 has a light emission unit and a first light receiving unit (a light emission unit 31A and a light receiving unit 31B in FIG. 6 to be described later). The upper side sensor 32 has a second light receiving unit (a light receiving unit 32B in FIG. 6). The light emission unit and the first light receiving unit are arranged facing the upper side sensor 32. The second light receiving unit is arranged facing the lower side sensor 31.

The lower side sensor 31 and the upper side sensor 32 are movable in the Y direction (i.e., the width direction of the sheet 60) perpendicular to the X direction which is the conveying direction of the sheet 60. The lower side sensor 31 and the upper side sensor 32 constitute one adjustable sensor. When the user adjusts the position of the lower side sensor 31 and the upper side sensor 32 in the Y direction, the lower side sensor 31 and the upper side sensor 32 can be caused to face each other. More specifically, the position in the width direction (Y direction) of the lower side sensor 31 and the upper side sensor 32 can be changed according to the position of the mark formed on the sheet 60 to be used.

As illustrated in FIG. 5B, the printer 1 has another pair of sensors, i.e., a lower side sensor 33 and an upper side sensor 34. In the conveying path of the sheet 60, the upper side sensor 34 is disposed at the upstream side (the side closer to the sheet supply port 12*a*) with respect to the lower side sensor 31 and the upper side sensor 32 and at the end portions of the width direction of the sheet 60. The lower side sensor 33 is located directly below the upper side sensor 34. For example, the lower side sensor 33 corresponds to a light emission unit (light emission unit 33 in FIG. 6), and the upper side sensor 34 corresponds to a light receiving unit (light receiving unit 34 in FIG. 6). The lower side sensor 33 and the upper side sensor 34 are arranged so as to face each other with the conveying sheet 60 interposed therebetween. The positions of the lower side sensor 33 and the upper side sensor 34 are fixed to the main body 10.

Figure 6:
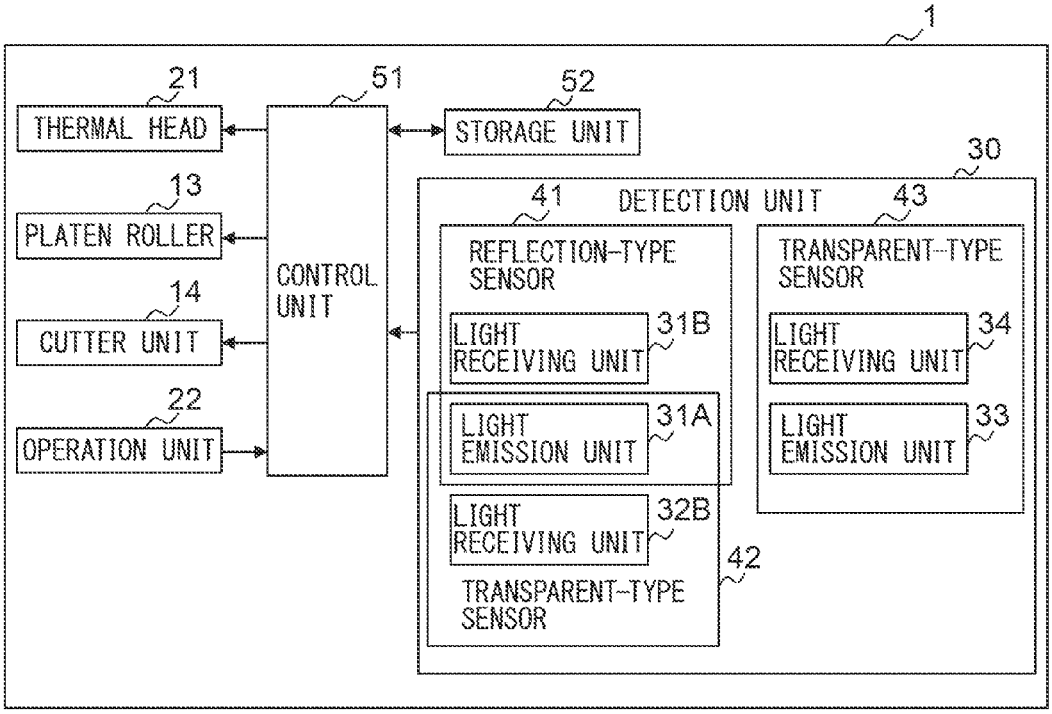
FIG. 6 is a schematic block diagram of the printer 1.
Figure 7:
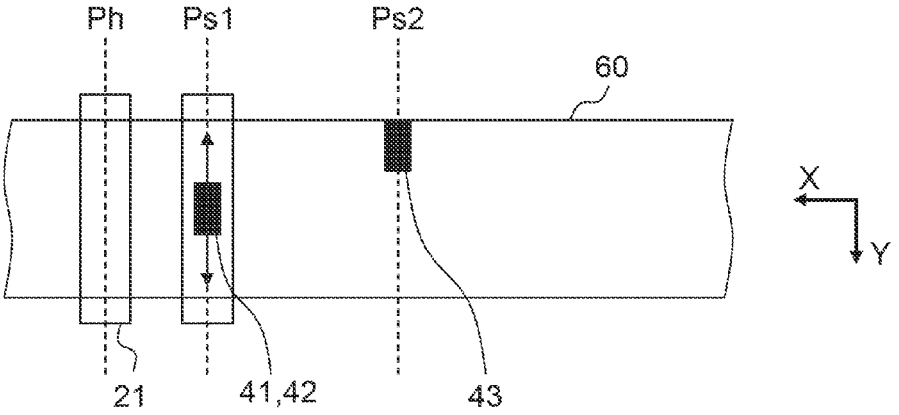
FIG. 7 is a plan view schematically illustrating the positions of the thermal head 21, a reflection-type sensor 41 and transparent-type sensors 42, 43 on the conveying path of the sheet 60.

FIG. 6 is a schematic block diagram of the printer 1. FIG. 7 is a plan view schematically illustrating the positions of the thermal head 21, a reflection-type sensor 41 and transparent-type sensors 42, 43 on the conveying path of the sheet 60. The printer 1 further includes a detection unit 30, a control unit 51, and a storage unit 52.

The detection unit 30 has one reflection-type sensor 41 and two transparent-type sensors 42, 43, and detects marks such as black marks or notches of the sheet serving as a reference for positioning the print area on the sheet 60 with these sensors. These sensors adopt marks different from each other as detection targets.

The reflection-type sensor 41 and the transparent-type sensor 42 are composed of the lower side sensor 31 and the upper side sensor 32. More specifically, the reflection-type sensor 41 is composed of the light emission unit 31A and the light receiving unit 31B arranged in the lower side sensor 31, and emits light from the light emission unit 31A to the sheet 60 and receives light reflected by the sheet 60 with the light receiving unit 31B. The transparent-type sensor 42 is composed of the light emission unit 31A arranged in the lower side sensor 31 and the light receiving unit 32B arranged in the upper side sensor 32, and emits light from the light emission unit 31A to the sheet 60 and receives the light transmitted through the sheet 60 with the light receiving unit 32B. The reflection-type sensor 41 and the transparent-type sensor 42 are realized as one adjustable sensor by the lower side sensor 31 and the upper side sensor 32. The light emission unit 31A of the lower side sensor 31 serves as not only the light emission unit of the reflection-type sensor 41 but also the light emission unit of the transparent-type sensor 42.

The transparent-type sensor 43 is composed of the lower side sensor 33 and the upper side sensor 34. As illustrated in FIG. 7, in the conveying path of the sheet 60, the transparent-type sensor 43 is located on the upstream side of the reflection-type sensor 41 and the transparent-type sensor 42, and is arranged at an end portion in the width direction (Y direction) of the sheet 60. The transparent-type sensor 43 emits light from the lower side sensor (light emission unit) 33 to the sheet 60, and receives the light transmitted through the sheet 60 with the upper side sensor (light receiving unit) 34. Unlike the reflection-type sensor 41 and the transparent-type sensor 42, the transparent-type sensor 43 is a fixed sensor which is not movable. The transparent-type sensor 43 detects a mark such as a notch formed at an end portion of the sheet 60.

Reference symbol Ph in FIG. 7 indicates the print position by the platen roller 13 and the thermal head 21 in the conveying direction (X direction) of the sheet 60. Reference symbol Ps1 indicates the detection position by the reflection-type sensor 41 and the transparent-type sensor 42. Reference symbol Ps2 indicates the detection position by the transparent-type sensor 43. These are arranged in the order of the detection position Ps2, the detection position Ps1, and the print position Ph, from the upstream side (the side closer to the sheet supply port 12*a*) to the downstream side (the side closer to the sheet discharge port 12*b*) of the conveying path.

The transparent-type sensor 43 may be replaced with a reflection-type sensor. Further, the reflection-type sensor 41 and the transparent-type sensor 42 do not need to be adjustable sensors, and their positions in the Y direction may be fixed. However, it is preferable that the detection unit 30 has both a reflection-type sensor and a transparent-type sensor, and that the plurality of sensors are arranged at positions different from each other in the width direction of the sheet 60 in order to detect marks at different positions in the width direction.

FIGS. 8A to 8D are plan views illustrating examples of the sheet 60. Marks such as black marks or notches for positioning are printed in advance on the sheet 60 that can be used with the printer 1 with a constant interval, and the positions and the types of these marks are different for each sheet. For example, the sheet 60 may be any of sheets 60A to 60D illustrated in FIGS. 8A to 8D.

Figure 8A:
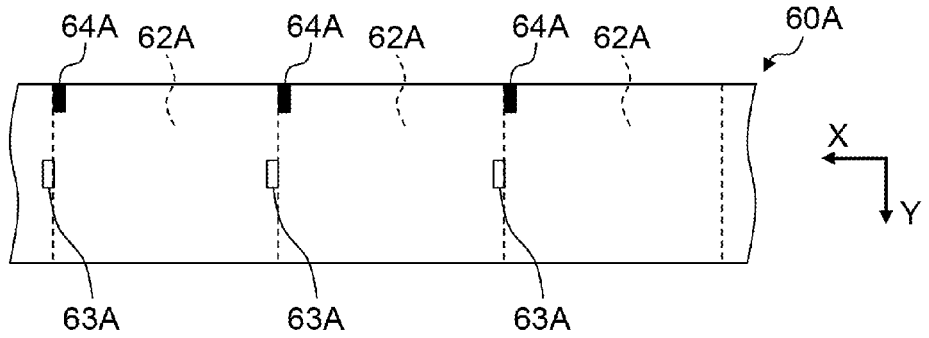
FIGS. 8A to 8D are plan views illustrating examples of the sheet 60.

FIG. 8A illustrates a sheet 60A with openings 63A and black marks 64A formed as two types of marks for positioning. The openings 63A are rectangular holes (center holes), and are formed at the center in the width direction of the sheet 60A. The black marks 64A are formed at an end portion of the width direction (Y direction) on the back surface of the sheet 60A, and at positions different from the openings 63A in the longitudinal direction (X direction, conveying direction) of the sheet 60A. The openings 63A and the black marks 64A are repeatedly arranged with a constant interval in the X direction. With these marks, the leading position of each print area 62A is indicated. When the sheet 60A is used, the openings 63A are detected by the transparent-type sensor 42, and the black marks 64A are detected by the reflection-type sensor 41.

Figure 8B:
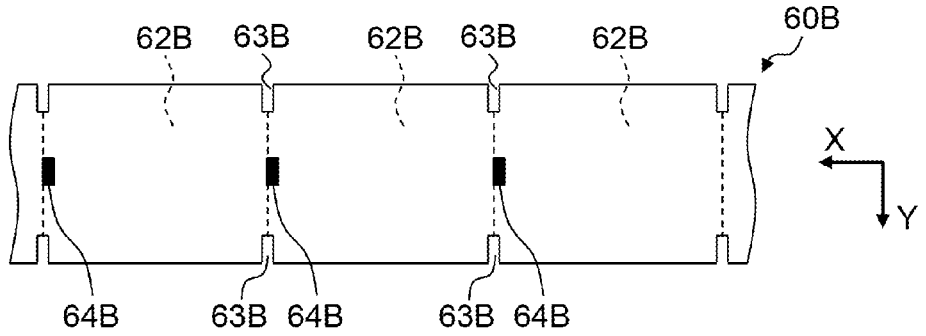

FIG. 8B illustrates a sheet 60B with notches 63B and black marks 64B formed as two types of marks for positioning. The notches 63B are formed at an end portion of the sheet 60B in the width direction. The black marks 64B are formed at the center in the width direction on the back side of the sheet 60B, and at positions different from the notches 63B in the longitudinal direction of the sheet 60B. The notches 63B and the black marks 64B are also repeatedly arranged with a constant interval in the X direction. With these marks, the leading position of each print area 62B is indicated. When the sheet 60B is used, the notches 63B are detected by the transparent-type sensor 42 or 43, and the black marks 64B are detected by the reflection-type sensor 41.

Figure 8C:
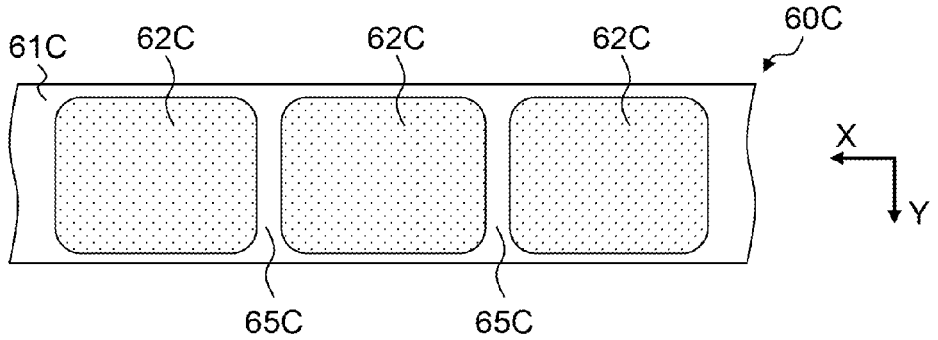

FIG. 8C illustrates a label sheet 60C without marks such as black marks formed. The sheet 60C has print areas 62C, which are label portions and are disposed on a band-like backing sheet 61C with a constant interval in the longitudinal direction thereof. Between the print areas 62C, gap portions 65C of only the backing sheet 61C are formed. When the sheet 60C is used, the gap portions 65C serve as marks for positioning. The gap portions 65C are detected by the transparent-type sensor 42 or 43.

Figure 8D:
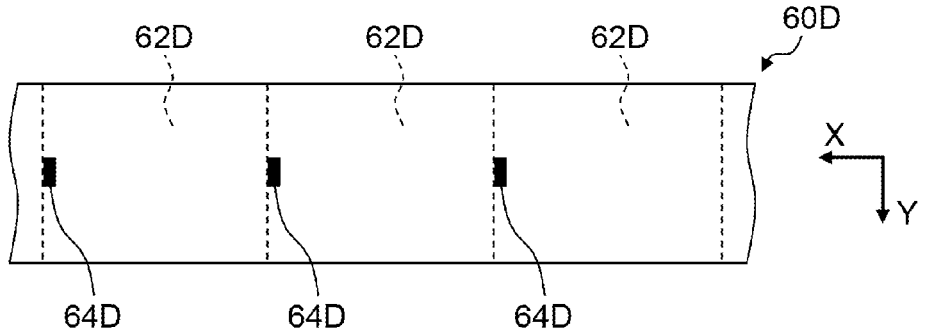

FIG. 8D illustrates a sheet 60D with black marks 64D formed as only one type of marks for positioning. The black marks 64D are formed at the center in the width direction on the back surface of the sheet 60B. With the black marks 64D, the leading position of each print area 62D is indicated. When the sheet 60D is used, the black marks 64D are detected by the reflection-type sensor 41.

In this way, the sheet used in the printer 1 is provided with notches, marks, openings, and the like, as marks indicating the leading positions of the print areas. The number, the positions, and the type of such marks are different for each sheet. In addition to the marks illustrated above, there are various combinations of marks of sheet, such as a sheet having no black mark and only notches formed thereon. The printer 1 uses three sensors, i.e., the reflection-type sensor 41 and the transparent-type sensors 42 and 43, so as to support multiple types of sheets. At the different positions in the width direction of the sheet, each sensor detects marks of detection targets thereof.

In particular, when a sheet is used in which two or more kinds of marks are formed at different positions in the conveying direction like the sheets 60A and 60B illustrated in FIGS. 8A and 8B, the printing start position in the print area is different depending on which mark is used as a reference. Therefore, in the following description, a process in which the printer 1 determines (specifies) the sensor to be used for the detection so that printing can be performed with reference to a mark for positioning suitable for the demand of the user will be described.

For example, each time the user exchanges the sheet 60, the user can input three priority ranks of the reflection-type sensor 41 and the transparent-type sensors 42, 43 via the operation unit 22 for the printer 1. More specifically, in the printer 1, the operation unit 22 functions as a receiving unit that receives information on priority ranks of the plurality of sensors. The priority ranks are an example of priority information concerning the sensor to be used preferentially. The input of these priority ranks is performed after the sheet 60 is exchanged and before the conveying of the sheet 60 is started by the print instruction. Regardless of the exchange of the sheet 60, the user may change the setting of the priority ranks of the sensors. Specifying the priority ranks of the sensors is synonymous with specifying the position and type of the mark to be used preferentially.

For example, it is assumed that the priority ranks of the sensors are set in the following order: the transparent-type sensor 42, the transparent-type sensor 43, and the reflection-type sensor 41, which are in the descending order of the priority ranks, and the sheet 60B of FIG. 8B is used as the sheet 60. In this case, a notch 63B is detected by the transparent-type sensors 42 and 43, and a black mark 64B is detected by the reflection-type sensor 41. However, the print area 62B is positioned based on the detection result by the transparent-type sensor 42 having the highest priority level among them. As another example, it is assumed that the priority ranks of the sensors are set in the following order: the transparent-type sensor 43, the reflection-type sensor 41, and the transparent-type sensor 42, which are in the descending order of the priority ranks, and the sheet 60C of FIG. 8C is used as the sheet 60. In this case, a gap portion 65C is detected by the transparent-type sensors 42 and 43. Therefore, the print area 62C is positioned based on the detection result by the transparent-type sensor 43 having the highest priority level among them.

When a sheet with only one kind of marks for positioning is used, only the sensor matching this kind of the marks makes detection, and thus this sensor is used regardless of the priority ranks. When a sheet with two or more kinds of marks for positioning is used, the priority ranks of the sensors are preset, and thus it is automatically determined which of the plurality of marks is used to position the sheet.

The priority information about the sensors may be input from an external device such as a host computer connected to the printer 1, rather than being input via the operation unit 22. In this case, the communication interface with the external device functions as a receiving unit.

The control unit 51 is composed of a control circuit including a CPU provided on the control board 50, and controls the printing (printing characters) operation of the printer 1. In particular, the control unit 51 performs specifying processing for specifying, from among the reflection-type sensor 41 and the transparent-type sensors 42, 43, a sensor that has detected the mark of the sheet 60 and whose priority rank input in advance is the highest. The control unit 51 controls the conveying of the sheet 60 by the platen roller 13 so that the print area on the sheet 60 is positioned at the print position Ph based on the detection result by the specified sensor.

In order to perform specifying processing of the sensor, when any one of the sensors detects the mark for positioning during conveying of the sheet 60, the control unit 51 causes the storage unit 52 to memorize the sensor. After detection, the control unit 51 checks which sensor detected the mark until the head of the print area reaches the print position Ph, and specifies a sensor having the highest preset priority rank from among the sensors at which detection occurs. Specification of the sensor may be performed when the head of the print area reaches the detection position Ps1 at the most downstream side of the three sensors, instead of when the head of the print area reaches the print position Ph. More specifically, in the case of the sensor arrangement in FIG. 7, the sensor may be specified when the head of the print area is conveyed to the detection position Ps1 after the detection is made at the detection position Ps2, or when the detection is made at the detection position Ps1.

Although processing for specifying the sensor may be performed at every time of printing, but it is sufficient to do it only at the time of first printing after exchanging the sheet 60. More specifically, the control unit 51 may not perform the above-described specifying processing at the time of printing the second and subsequent sheets after exchanging the sheet 60, and the control unit 51 may cause the mark to be detected only by the sensor specified in the specifying processing at the time of the first printing, and may allow the operation of the other sensors at a stop.

The storage unit 52 includes a nonvolatile or volatile memory such as a ROM and a RAM provided on the control board 50. The storage unit 52 stores various data necessary for the operation of the printer 1 and image data to be printed as necessary. In particular, the storage unit 52 stores priority information about the sensors input to the printer 1, and the sensor specified by the specifying processing from among the reflection-type sensor 41 and the transparent-type sensors 42, 43.

Figure 9:
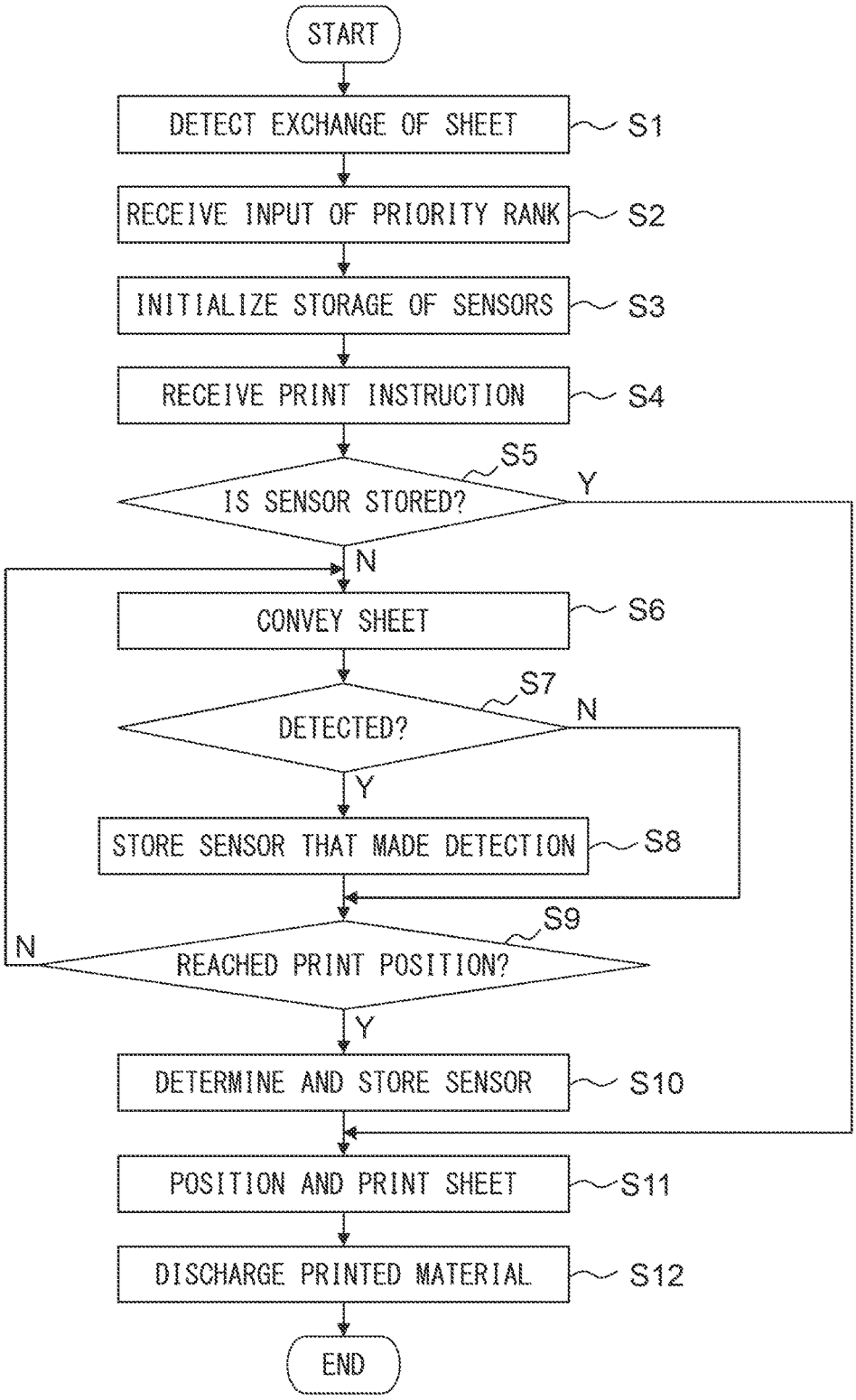
FIG. 9 is a flowchart illustrating an operation example of the control unit 51.

FIG. 9 is a flowchart illustrating an operation example of the control unit 51. The illustrated flow is executed by the CPU in the control unit 51 in accordance with a program stored in advance in the storage unit 52.

First, when the sheet 60 of the printer 1 is exchanged by the user and the leading edge of the newly attached sheet 60 is inserted into the printer 1 from the sheet supply port 12*a*, the control unit 51 detects the exchange of the sheet 60 (S1). The user inputs three priority ranks of the reflection-type sensor 41 and the transparent-type sensors 42 and 43 via the operation unit 22, and the control unit 51 receives input of this priority ranks (S2). The control unit 51 initializes the memory of the sensors in the storage unit 52 (S3). When a print instruction is input in this state, the control unit 51 receives the print instruction (S4).

The control unit 51 determines whether or not any of the sensors is stored in the storage unit 52 (S5). At the time of printing the second and subsequent sheets after the exchange of the sheet 60, the sensor determined in the specifying processing at the time of the first printing is stored in the storage unit 52 (Yes in S5), and therefore, the processing proceeds to S11 to be described later. On the other hand, at the time of the first printing after the exchanging of the sheet 60, there is no memory about the sensors (No in S5), so the processing proceeds to S6 subsequent thereto.

At the time of the first printing after exchanging of the sheet 60, the control unit 51 rotates the platen roller 13 to cause the sheet 60 to be conveyed (S6), and determines whether or not the mark for positioning is detected by any sensor (S7). When a detection is made (Yes in S7), the control unit 51 causes the storage unit 52 to memorize which sensor detected the mark (S8), and the processing proceeds to the next S9. When neither of the sensors detects the mark, the process proceeds to S9 without executing S8.

On the basis of the distance between the print position Ph and the detection position (Ps1 or Ps2) of the sensor at which detection occurs and the rotation rate of the platen roller 13, the control unit 51 determines whether or not the head of the print area of the sheet 60 has reached the print position Ph (S9). When the head of the print area has not yet reached the print position Ph (No in S9), the process returns to S6 to repeat the processing of S6 to S9 until the head of the print area reaches the print position Ph. When the head of the print area reaches the print position Ph (Yes in S9), the control unit 51 specifies a sensor having the highest preset priority rank from among the sensors stored in the storage unit 52 (S10). The control unit 51 determines the sensor as a sensor actually used for positioning the sheet 60, and stores it in the storage unit 52. When none of the sensors can detect the mark for positioning, error processing is performed.

The control unit 51 controls the rotation of the platen roller 13 based on the detection result of the sensor determined in S10 and stored in the storage unit 52 and thereby causes the head of the print area of the sheet 60 to be positioned at the print position Ph, and causes the thermal head 21 to execute printing on the print area (S11). After printing in S11, the control unit 51 further causes the sheet 60 to be conveyed by the rotation of the platen roller 13, causes the cutter unit 14 to cut the trailing end of the print area after printing, and thereby causes the printed material to be discharged from the sheet discharge port 12*b* to the outside of the printer 1 (S12). According to the above, the operation of the printer 1 is finished.

In the operation example illustrated in FIG. 9, the control unit 51 automatically determines the sensor to be used for positioning the sheet 60 according to the priority ranks of the sensors input in advance. Thus, for example, when a sheet with two or more kinds of marks for positioning is used, which sensor is to be used to position the sheet is determined in accordance with the priority ranks of the sensors determined by the user. More specifically, with which mark the sheet is to be positioned is determined according to the priority ranks of the sensors decided by the user, and therefore, it is possible to perform the printing based on the position suitable for the demand of the user. There is an advantage in that the detection error is reduced when a higher priority rank is given to a sensor having high detection sensitivity among the plurality of sensors.

In the specifying processing of the sensor, the control unit 51 may determine, from among the sensors that detected the mark, the sensor actually used for the positioning of the sheet 60, taking into consideration the output level difference between detection and non-detection. For example, the control unit 51 may determine whether or not the output level difference between detection and non-detection exceeds a predetermined reference value for each of the sensors that detected the mark, and determine the sensor having the highest priority rank as the actually used sensor among the sensors that satisfy that condition. The reference value in this case may be different for each sensor. Alternatively, the user may set priority ranks of some sensors to the same rank. In this case, if the sensors of the same rank make detection, the control unit 51 may determine, from among these sensors, the sensor having the largest difference in output level between detection and non-detection as a sensor to be actually used.

The specifying processing of the sensor may be performed only when the printer 1 operates in a specified mode out of a plurality of operation modes. Examples of operation modes include an automatic mode in which the sensor used for positioning the sheet is determined according to prestored priority information, a fixed mode in which one sensor is always used regardless of the priority information, and a continuous sheet mode in which no sensor is used. Selection of these modes can be carried out, for example, by the user operating the operation unit 22.

The priority information on the sensor to be used preferentially may not be input by the user operating the operation unit 22 by himself or herself, but may be stored in advance in the storage unit 52 which is the ROM built in the printer 1 when the printer 1 is manufactured. In this case, for example, when the printer 1 operates in the automatic mode, the manufacturer determines which of the plurality of sensors the printer 1 uses preferentially, according to the demand of the user. The storage unit 52 stores the information as priority information.

In the automatic mode, for example, out of the three sensors of the printer 1, the reflection-type sensor 41 does not function (invalidated), and only two of the transparent-type sensors 42 and 43 function. More specifically, the adjustable sensor formed by the lower side sensor 31 and the upper side sensor 32 functions as the transparent-type sensor 42 instead of the reflection-type sensor 41.

Figure 10:
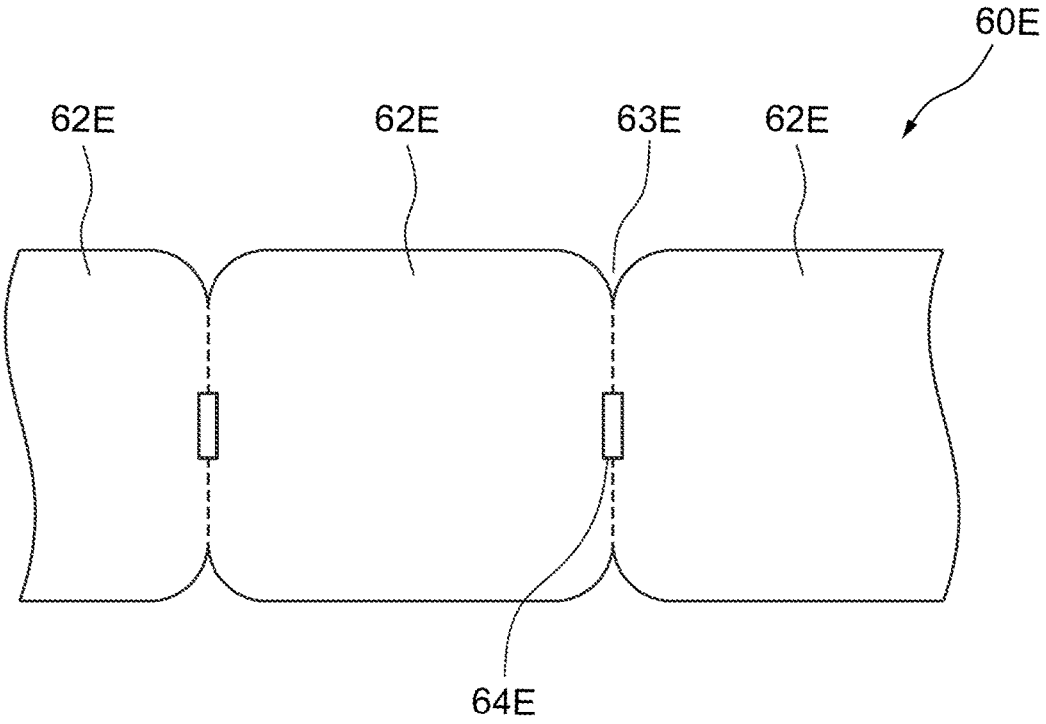
FIG. 10 is a plan view illustrating an example of another sheet 60E.

The case where the reflection-type sensor 41 does not function and the transparent-type sensors 42 and 43 function is suitable, for example, for the print of a sheet 60E illustrated in FIG. 10. FIG. 10 is a plan view illustrating an example of another sheet 60E. In the sheet 60E illustrated in FIG. 10, notches 63E and openings 64E are formed as marks for positioning. The notches 63E are formed by rounding the corners of the print area indicated by the reference symbol 62E, and are detected by the transparent-type sensor 43. The openings 64E are rectangular holes formed in the center of the width direction of the sheet 60A, and are detected by the transparent-type sensor 42. There is no mark detected by the reflection-type sensor 41 on the sheet 60E.

If two sensors are used, for example, when a sensor having the higher priority level makes detection first, the printer 1 uses the detection result of that sensor, and when only the other sensor having the lower priority level makes detection, the printer 1 uses the detection result of that sensor. When the sensor having the higher priority level makes detection during conveying of the sheet, even if the sensor having the lower priority level makes detection first, the printer 1 uses the detection result of the sensor having the higher priority level.

In this way, the printer 1 uses the detection result of the sensor having the higher priority level according to the priority information stored in the storage unit 52. In this case, the priority information about the invalidated reflection-type sensor 41 may not be stored. Since sensors for which no priority information is stored can be regarded as having low priority levels, it is sufficient that information indicating which of the transparent-type sensors 42, 43 is to be adopted preferentially is stored as the priority information. More specifically, the priority information does not necessarily have to be set for all the sensors. The priority information may be set for only some sensors functioning during conveying of the sheet (e.g., the sheet 60E) out of the plurality of sensors.

Figure 11:
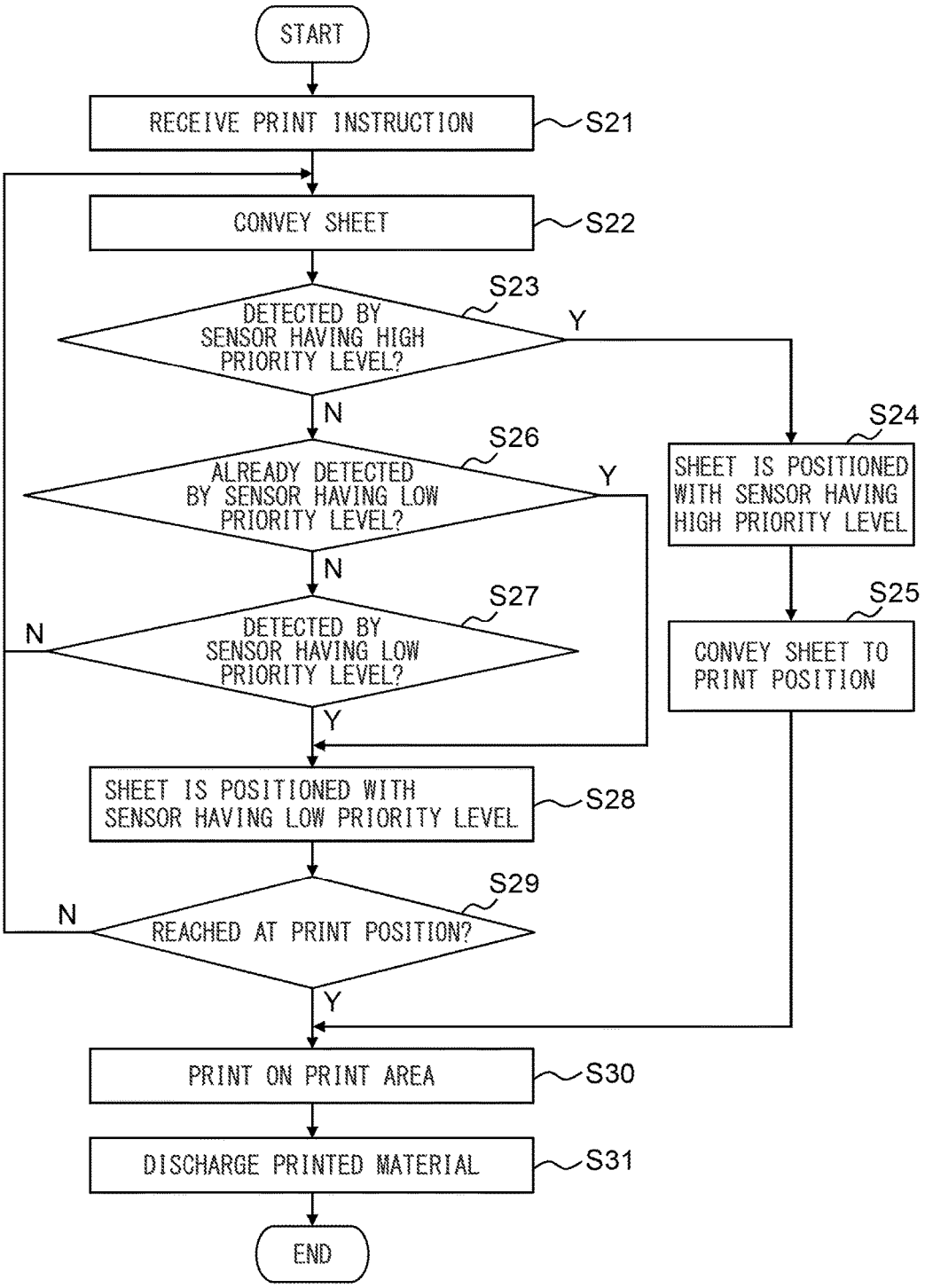
FIG. 11 is a flowchart illustrating another operation example of the control unit 51.

FIG. 11 is a flowchart illustrating another operation example of the control unit 51. FIG. 11 illustrates an operation example in which two sensors, i.e., the transparent-type sensors 42 and 43 are used for positioning the sheet 60E, and in which the transparent-type sensor 42 at the downstream side in the conveying direction has a higher priority rank (priority level) than the transparent-type sensor 43 at the upstream side.

First, similar to the case of the operation example in FIG. 9, the control unit 51 receives a print instruction (S21), and rotates the platen roller 13 to cause the sheet 60E to be conveyed (S22). When the mark is detected by the transparent-type sensor 42 having a high priority level (Yes in S23), the control unit 51 specifies the transparent-type sensor 42 as a sensor used for positioning the sheet 60E, and causes the sheet 60E to be positioned at the print position Ph on the basis of the detection result of the transparent-type sensor 42 (S24). In this case, the control unit 51 causes the sheet 60E to be conveyed to the print position based on the detection result of the transparent-type sensor 42 (S25), after which the processing proceeds to S30.

When the transparent-type sensor 42 does not detect anything (No in S23), the control unit 51 determines whether or not the mark has been detected by the transparent-type sensor 43 having a low priority level (S26). When the mark has not been detected by the transparent-type sensor 43 (No in S26), the control unit 51 determines whether or not the mark is detected by the transparent-type sensor 43 having a low priority level (S27). In the case where the mark has just been detected by the transparent-type sensor 43 (Yes in S27)

or where the mark has already been detected by the transparent-type sensor 43 (Yes in S26), the control unit 51 causes the sheet 60E to be positioned at the print position Ph on the basis of the detection result of the transparent-type sensor 43 (S28).

When there is no detection in any of the transparent-type sensors 42 and 43 (No in S27) or when the head of the print area of the sheet 60E has not reached the print position Ph (No in S29), S22 is subsequently performed so that the control unit 51 continues the conveying of the sheet 60E, and the operations of S22 to S28 are repeatedly executed. As a result of repeatedly executing the operations of S22 to S28, when the mark is not detected by the transparent-type sensor 42 having a high priority level until the head of the print area of the sheet 60E reaches the print position Ph in S29 (All is No in S23), the control unit 51 specifies in S28 the transparent-type sensor 43 as the sensor used for positioning the sheet.

When the sheet 60E is positioned in S24 and S28, the control unit 51 causes the thermal head 21 to execute print to the print area (S30), and discharge the printed material from the sheet discharge port 12*b* (S31). According to the above, the operation of the printer 1 is finished.

In the operation example of FIG. 9, an example is illustrated in which the head of the print area of the sheet 60 is positioned at the print position Ph in S9, and the head of the print area of the sheet 60 is also positioned at the print position Ph in S11. For example, the operation example in FIG. 9 is suitable for a case of operation where the head of the print area is fed to the print position Ph by using the detection result of the sensor that made the detection first in S7, and thereafter, the head of the print area is fed to the print position Ph in S11 by using the detection result of the sensor determined by the specifying processing of the sensor. When the sensor that made the detection first in S7 is the sensor with the highest priority level, the positioning of the sheet in S11 can be omitted. However, for example, in the case where the print in S11 is started from a position other than the head of the print area, it is necessary to position the sheet in S11 even if the sensor that made the detection first in S7 is the sensor with the highest priority level.

As described above, the control unit 51 of the printer 1 causes the sheet 60 to be conveyed in a state in which the priority information is received in advance and stored in the storage unit 52, and specifies the sensor used for positioning the sheet 60 on the basis of the priority information and the detection result indicating which sensor detected the mark during conveying. Like the operation examples illustrated in FIGS. 9 and 11, the priority information may be stored in advance at least before the sheet is conveyed in order to determine the sensor with which the sheet is positioned. In particular, when the priority information about the sensors is not input by the user when the printer 1 is used, and when the priority information can be determined in advance by the user and the manufacturer according to the type of the sheet 60 used by the user and the use of the printer 1, the priority information may be stored in the storage unit 52 during manufacturing process. This can realize, in the easiest manner for the user, printing based on a positioning mark matching user's demand out of the positioning marks formed on the continuous sheet to be used.

It is to be understood that, like the operation example illustrated in FIG. 9, even in the operation example illustrated in FIG. 11, information indicating that the descending order of the priority ranks is set as the transparent-type sensor 42 and the transparent-type sensor 43 may be stored in the storage unit 52 as the priority information about the transparent-type sensors 42, 43. In this case, with the transparent-type sensors 42 and 43, the control unit 51 can perform the same processing as S3 to S12 in the operation example of FIG. 9.

Even in the case of the operation example illustrated in FIG. 11, the reflection-type sensor 41 may be activated and operated as in the operation example illustrated in FIG. 9. In this case, the information about the priority ranks of the three sensors, i.e., the reflection-type sensor 41 and the transparent-type sensors 42 and 43, is stored in the storage unit 52 in the manufacturing process of the printer 1, so that, at the time of printing, the control unit 51 can perform the same processing as S3 to S12 in FIG. 9.

Like the operation example illustrated in FIG. 11, in the case of the operation example illustrated in FIG. 9, an operation mode in which the reflection-type sensor 41 does not function and the transparent-type sensors 42 and 43 function may be provided. In this case, like the operation example illustrated in FIG. 11, information about which of the transparent-type sensors 42 and 43 is to be used preferentially is received via the operation unit 22 serving as a receiving unit and stored in the storage unit 52, so that, the control unit 51 can perform the same processing as S21 to S29 in FIG. 11.

In the case of the operation example illustrated in FIG. 9, it is also possible to give priority information indicating a high priority level to only one of the three sensors 41 to 43 functioning during conveying.

In this case, for example, processing similar to S26 to S28 in FIG. 11 can be performed for each of the two sensors with a low priority level (priority information is not given). More specifically, the same processing as S26 to S28 performed by the second sensor with the low priority level may be inserted between S28 and S29 in FIG. 11. When the mark is detected by both of the two sensors with the low priority level and the sheet 60 reaches the print position Ph in S29, the control unit 51 specifies one of the two sensors with the low priority level as the sensor used for the positioning of the sheet 60. For example, the difference in the output level between the detection and the non-detection described in the operation example illustrated in FIG. 9 can be used for specifying the sensor.

Since the specifying processing of the sensor does not depend on the print method, the specifying processing of the sensor can be applied to printers other than the thermal printer. A printer that performs the specifying processing of the sensor may be any of an inkjet printer, an electrophotographic printer, a dot impact printer, a sublimation-type printer, and the like, as long as the printer uses a continuous sheet, and its printing method is not particularly limited.

The preceding description is merely to illustrate and describe exemplary embodiments of the present invention. It is not intended to be exhaustive or limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, the invention is not limited to the particular embodiment disclosed as the best mode contemplated for carrying out this invention, but the invention includes all embodiments falling within the scope of the claims. The invention may be practiced otherwise than is specifically explained and illustrated without departing from its spirit or scope.

What is claimed is:

1. A printer comprising:

a conveying unit conveying a continuous sheet in accordance with an input print instruction;

a plurality of sensors detecting a mark serving as a reference for positioning a print area on the continuous sheet, wherein the plurality of sensors adopt marks different from each other as detection targets;

a printing unit printing on a print area of the continuous sheet;

a storage unit storing priority information about a sensor to be used preferentially among the plurality of sensors; and a control unit controlling the conveying unit so that the print area is positioned at a print position of the printing unit, on the basis of both the priority information and a detection result indicating whether each of the plurality of sensors has detected the mark or not during conveying of the continuous sheet, wherein the priority information is stored in advance in the storage unit before conveying for detecting the mark is performed, wherein the priority information specifies at least a sensor whose priority rank is the highest, and the priority rank is unchanged regardless of the detection result.

2. The printer according to claim 1, wherein the storage unit is a ROM, and stores the priority information since the printer is manufactured.

3. The printer according to claim 2, wherein the priority information is set only for some of the plurality of sensors that function during conveying of the continuous sheet.

4. The printer according to claim 1, further comprising a receiving unit receiving an input of the priority information stored in the storage unit before conveying of the continuous sheet is started in response to the print instruction.

5. The printer according to claim 4, wherein the receiving unit is an operation unit provided on a main body of the printer to be manipulated by a user.

6. The printer according to claim 1, wherein the control unit performs specifying processing for specifying, from among the plurality of sensors, a sensor which has detected the mark before a head of the print area is conveyed to the print position of the printing unit and whose priority rank indicated by the priority information is the highest, and controls the conveying unit on the basis of a detection result with the specified sensor.

7. The printer according to claim 6, wherein the storage unit further stores the sensor specified in the specifying processing, and the control unit performs the specifying processing in a first printing after the continuous sheet is exchanged, and causes only the specified sensor out of the plurality of sensors to detect the mark during printing of second and subsequent sheets.

8. The printer according to claim 6, wherein the sensor specified in the specifying processing is a sensor whose difference in an output level between detection and non-detection exceeds a reference value determined in advance.

9. The printer according to claim 1, wherein the plurality of sensors detect the mark at positions different from each other in a width direction of the continuous sheet.

10. The printer according to claim 1, wherein the plurality of sensors include a reflection-type sensor emitting light to the continuous sheet and receiving light reflected by the continuous sheet and a transparent-type sensor emitting light to the continuous sheet and receiving light transmitted through the continuous sheet.

11. The printer according to claim 1, wherein the control unit specifies a sensor to be used preferentially from among the plurality of sensors in a first printing after the continuous sheet is exchanged, and causes only the specified sensor out of the plurality of sensors to detect the mark during printing of second and subsequent sheets.

12. A printer comprising:

a conveying unit conveying a continuous sheet in accordance with an input print instruction;

a plurality of sensors detecting a mark serving as a reference for positioning a print area on the continuous sheet, wherein the plurality of sensors adopt marks different from each other as detection targets;

a printing unit printing on a print area of the continuous sheet;

a storage unit storing priority information about a sensor to be used preferentially among the plurality of sensors; and a control unit controlling the conveying unit so that the print area is positioned at a print position of the printing unit, on the basis of both the priority information and a detection result indicating whether each of the plurality of sensors has detected the mark or not during conveying of the continuous sheet, wherein the priority information is stored in advance in the storage unit before conveying for detecting the mark is performed, wherein the control unit specifies a sensor to be used preferentially from among the plurality of sensors in a first printing after the continuous sheet is exchanged, and causes only the specified sensor out of the plurality of sensors to detect the mark during printing of second and subsequent sheets.

* * * * *